US006111229A

United States Patent [19]

Schultheis

[11] Patent Number: 6,111,229

[45] Date of Patent: Aug. 29, 2000

[54] COOKING APPLIANCE SUCH AS A STOVE WITH AN ARRANGEMENT OF A CERAMIC HEATING ELEMENT AS A COOKING ZONE IN A CUTOUT OF A COOKING SURFACE

[75] Inventor: Bernd Schultheis, Schwabenheim, Germany

[73] Assignee: Schott Glas, Mainz, Germany

[21] Appl. No.: 09/177,336

[22] Filed: Oct. 22, 1998

[30] Foreign Application Priority Data

Oct. 23, 1997 [DE] Germany ..... 197 46 844

[51] Int. Cl.[7] ..... H05B 3/68; F24C 15/10

[52] U.S. Cl. ..... 219/452.11; 219/465.1; 219/468.1; 126/211

[58] Field of Search ..... 219/443.1, 451.1, 219/452.11, 452.12, 454.12, 456.1, 460.1, 461.1, 462.1, 465.1, 466.1, 467.1, 468.1, 468.2; 126/211, 217, 214 A, 90 A, 92 A, 92 B

[56] References Cited

U.S. PATENT DOCUMENTS

| | | | |
|---|---|---|---|
| 2,727,133 | 12/1955 | Scofield | 219/468.2 |
| 3,355,575 | 11/1967 | Bassett, Jr. et al. | 219/460.1 |
| 3,406,278 | 10/1968 | Bassett, Jr. et al. | 219/460.1 |
| 3,646,321 | 2/1972 | Siegla | 219/465.1 |
| 3,686,477 | 8/1972 | Dills et al. | 219/456.1 |
| 3,739,149 | 6/1973 | Fischer et al. | 219/465.1 |
| 3,885,128 | 5/1975 | Dills | 219/468.1 |
| 4,476,946 | 10/1984 | Smith | 219/445.1 |

FOREIGN PATENT DOCUMENTS

| | | |
|---|---|---|
| 0069298 | 1/1983 | European Pat. Off. . |
| 29702418 U | 3/1997 | Germany . |
| 19633141 | 10/1997 | Germany . |
| 9609738 | 3/1996 | WIPO . |

*Primary Examiner*—Sang Paik
*Attorney, Agent, or Firm*—Nils H. Ljungman & Associates

[57] ABSTRACT

Arrangement of an electrical heating element as a cooking zone, having as a carrier a ceramic of very high thermal conductivity, in a cutout of a cooking surface comprising glass-ceramic, glass, ceramic, metal or plastic. The ceramic carrier of the heating element has, above the plane of the cooking surface, a region, by means of which region the carrier engages over the cutout onto the top of the cooking surface and by means of which region the carrier rests on the cooking surface by a gasket. The ceramic carrier forms, in the plane of the cooking surface, a further region, by which further region the carrier is positioned in the cutout at a distance from the end faces of the latter, and, below the plane of the cooking surface, a region having shaped-out portions serves as a bearing for an element which element, with the aid of the cooking surface as an abutment, fixes the heating element in the cutout of the cooking surface.

20 Claims, 4 Drawing Sheets

COOKING APPLIANCE SUCH AS A STOVE WITH AN ARRANGEMENT OF A CERAMIC HEATING ELEMENT AS A COOKING ZONE IN A CUTOUT OF A COOKING SURFACE

BACKGROUND OF THE INVENTION

1. Field of the Invention

The present invention relates to the arrangement of an electrical heating element as a cooking zone, the cooking zone having as a carrier a ceramic of very high thermal conductivity, in a cutout of a cooking surface consisting of glass-ceramic, glass, ceramic, metal or plastic.

2. Background Information

Cooking appliances having glass-ceramic cooking surfaces are known. In these appliances, the cooking zones are heated, as a rule, by means of electrically operated or gas-operated heating devices arranged below the glass-ceramic cooking surface in the region of the cooking zones. These heating devices may, for example, be electrically operated contact-heating or radiant-heating elements or else gas-jet burners.

One disadvantage is held to be the delayed emission of heat through the plate onto the product to be heated, along with a correspondingly lower energy utilization (efficiency) of the heating medium and, as a result, a longer cooking time.

The use of electrical heating elements as cooking zones or cooking plates, having as a carrier an electrically insulating ceramic which, however, is of very high thermal conductivity, in electrical cooking appliances is known per se, for example from European Patent No. 0,069,298 B1. This publication refers, inter alia, to the fact that silicon nitride is particularly suitable as cooking-plate material on account of its high thermal conductivity, low thermal expansion and, at the same time, high resistance to cyclic temperature stress. According to this European patent specification, the material has high mechanical strength and can therefore be designed as a thin plate. This results in the plate having low thermal capacity, so as also to substantially ensure that the heat supply can be regulated quickly and without any inertia or delay.

The subject of WO 96/09738 is likewise an electrical heating element which has an electrically insulating, thermally conductive carrier consisting of ceramic, in particular of silicon nitride, and has an electrically conductive layer or foil applied to the carrier and provided with electrical contacts, the carrier being designed so as to be plate-like and so solid that it acts as a heat sink.

Due to the high thermal conductivity of the ceramic, the heat flow through the cooking plates onto the product to be heated is particularly high; the heating-up speed, reaction speed and energy utilization are therefore particularly advantageous here.

On the other hand, on account of the very high thermal conductivity of the ceramic, a one-piece cooking surface cannot be used, as is possible in the case of cooking appliances having glass-ceramic cooking surfaces, since the heat would then flow away out of the hot region. In such a case, energy utilization would be impaired and the temperatures permissible on the frame of the appliance would be exceeded. It is therefore necessary to insert such a heating element as a cooking zone, having as a carrier a ceramic of very high thermal conductivity, into a baseplate so as to be thermally insulated.

Furthermore, the high thermal conductivity of the ceramic material prevents multi-circuit cooking zones from being designed with diameters or broiling zones adapted to the cooking utensil and having independently switchable and controllable zones, such as have already been known for years in the case of glass-ceramic cooking surfaces and, in general, are used to good effect. Specifically, here, adjacent zones would also be mutually heated.

Thus, despite the abovementioned advantages, as compared with cooking appliances having glass-ceramic cooking surfaces or zones, cooking appliances, the cooking zones of which are formed solely by ceramic cooking plates of very high thermal conduction, have a whole series of disadvantages.

These disadvantages are taken into account in German utility model 297 02 418.3, the subject of which is a cooking appliance having a glass-ceramic cooking surface with a plurality of cooking zones, at least one of which is designed as a high-speed cooking zone, the cooking zones being heatable essentially by means of electrically operated heating devices, and the high speed cooking zone being formed by a ceramic cooking plate integrated into the glass-ceramic cooking surface, the ceramic cooking plate being capable of consisting of $Si_3N_4$ or SiC. According to this utility model, the ceramic cooking plate either is inserted directly into the glass-ceramic cooking surface or is glued into a corresponding cutout in the glass-ceramic cooking surface by means of a silicone adhesive, or the ceramic cooking plate is inserted into a plate consisting of thermally insulating ceramic, of metal or of prestressed glass and the latter plate is, in turn, inserted into a cutout of the glass-ceramic cooking surface.

However, all these assembling and gluing methods have considerable disadvantages in practice and in long-term use. Ceramic plates can have appreciable thermal expansion. Since a cooking plate consisting of ceramic therefore expands during operation, high operating temperatures should not occur when such a cooking plate is assembled together with, for example, brittle materials, such as glass-ceramic, glass or ceramic.

Alternatively, gluing may be carried out with a permanently elastic material. However, these permanently elastic materials are typically also resistant only up to about 300° C. Furthermore, the tempering resistance of ceramic plates is typically around 300 K.

The operating temperature of such ceramic cooking plates is therefore restricted to about 250° C. up to a maximum of about 300° C. However, so that the ceramic cooking plate can be used at these lower temperatures, it is necessary to employ costly special pots having a highly planar bottom which is likewise of very high thermal conductivity.

By contrast, due to the lack of planeness in the bottoms of commercially available utensils, cooking zone temperatures of up to 600° C. are typically required, in order to bring the product to be heated to boiling smoothly. For this purpose, therefore, special temperature sensors and regulating devices can additionally be necessary in the case of cooking appliances having ceramic cooking plates.

OBJECT OF THE INVENTION

The object of the present invention is, therefore, to present an arrangement in which an electrical heating element as a cooking area or ring or zone, having as a carrier an electrically insulating ceramic which, however, is of very high thermal conductivity, is integrated in a cutout of a cooking surface or hob consisting of glass-ceramic, glass or ceramic, metal or plastic, without any adhesive bonding, the arrangement being electrically reliable, highly thermally resistant (about 400° C. to about 500° C.) and leak-tight against the penetration of liquids into the interior of the appliance.

Furthermore, an object of the invention is to take into account the respective particular properties of the materials involved in this arrangement and to allow a markedly higher operating temperature of the ceramic heating elements of up to about 500° C.

SUMMARY OF THE INVENTION

This object can be achieved in that the ceramic carrier of the heating element can have, above the plane of the cooking surface, a region or zone or insert, by means of which region the carrier engages over the cutout onto the top of the cooking surface. Through the region, the carrier can rest on the cooking surface itself by means of a gasket, and the ceramic carrier can form, substantially in the plane of the cooking surface, a further region or zone or insert. Via the further region, the carrier can be positioned in the cutout at a distance from the end faces of the latter. Below the plane of the cooking surface, a region or insert can have shaped-out portions serving as a bearing for an element which, with the aid of the cooking surface as an abutment, can fix the heating element positively in the cutout of the cooking surface.

In this case, the shaped-out portions of the ceramic carrier of the heating element in the region below the plane of the cooking surface may be designed as grooves, threads, bosses or bores, which make it possible to connect the ceramic heating elements catchably or else screwably to the moulding surrounding them.

In a further embodiment, additional metal parts can be fixed to the ceramic heating element by means of a hard-solder joint or additional ceramic parts can be fixed to the ceramic heating element by means of ceramic adhesives, the parts having grooves, threads, bosses or bores in the region below the cooking surface. In this case, special gaskets comprising a graphite-containing material and/or a ceramic fiber material can be used, the gaskets substantially ensuring, on the one hand, sufficient sealing-off and, on the other hand, heat insulation between the ceramic heating elements and the mouldings surrounding them.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention will be described in more detail with reference to the following figures and exemplary embodiments, wherein.

DESCRIPTION OF THE PREFERRED EMBODIMENT

Figure 1:
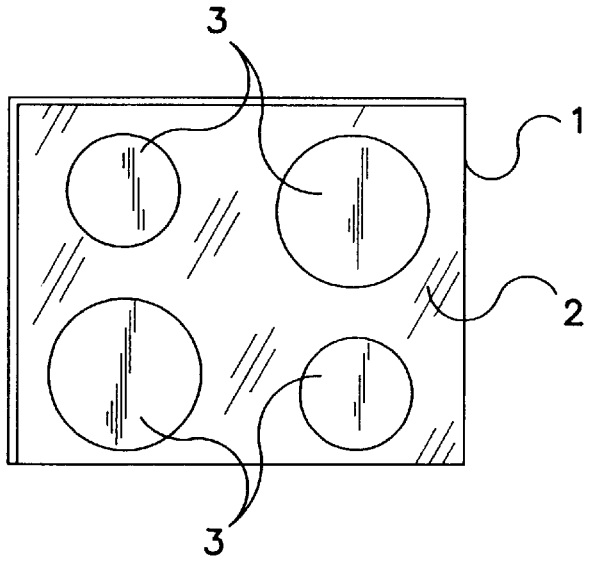
FIG. 1 shows a diagrammatic top view of the arrangement of a cooking hob.

FIG. 1 shows a diagrammatic top view of a cooking region or hob 1 with a moulding 2 as a cooking surface comprising glass-ceramic and with the ceramic heating elements 3 arranged therein. The moulding 2 may also comprise a metallic material or of a special thermally resistant plastic, for example of a duroplastic material (for example UP or MF) or thermo-plastic material (for example: PEI, PPS, PES, PPA, PET, PBT).

The ceramic heating elements 3 can comprise silicon nitride ($Si_3N_4$) and/or silicon carbide (SiC). In at least one embodiment of the present invention, the heating elements 3 can additionally comprise aluminum oxide ($Al_2O_3$) or aluminum nitride (AlN), or mixed ceramics. If appropriate, aluminum oxide ($Al_2O_3$) or aluminum nitride (AlN), or mixed ceramics can be applied to the heating conductors 4 which are electrically contacted at 9. In the case of electrically conductive ceramic materials, an insulating layer, not illustrated here, can be necessary between the heating conductors 4 and the ceramic carrier plate 3.

Figure 2:
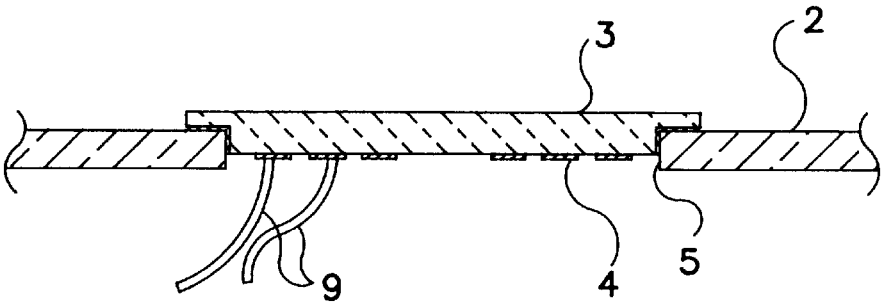
FIG. 2 shows the hitherto conventional or known installation arrangement in section.

FIG. 2 shows in section the installation arrangement which has been conventional hitherto according to known cooking surfaces and in which the ceramic heating elements 3 are glued by means of a silicone adhesive 5 in the moulding 2, for example pre-stressed glass or glass-ceramic, which surrounds them. The silicone adhesive 5 currently limits the operating temperature to typically 200° C. (max. 300° C.). Other adhesives are not suitable for use here because of their inadequate permanently elastic properties.

The often different thermal expansions of the materials involved, on one side, for example, glass ceramic as the cooking surface 2, for example CERAN (alpha less than $0.2*10^{-6}$/K) and, on the other side, $Si_3N_4$ (alpha about $3.6*10^{-6}$/K) as the ceramic heating element 3, substantially prevent ceramic adhesives resistant to high temperature from being used here.

Figure 3:
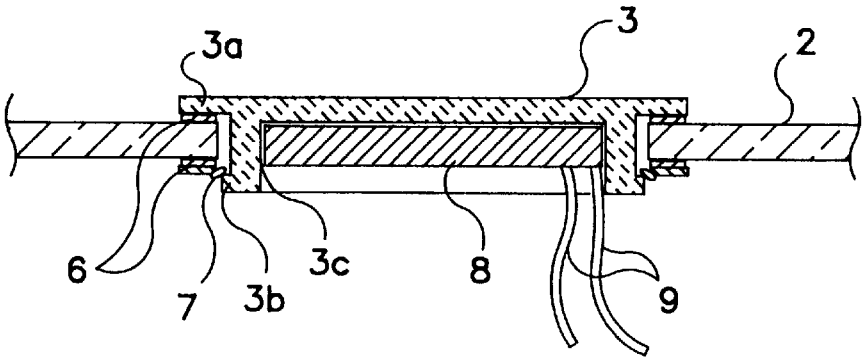
FIG. 3 shows a possible arrangement according to the present invention in section.

FIG. 3 shows in section a possible design of the arrangement according to the present invention. The ceramic heating element 3 possesses, on the one hand, a portion 3*a* engaging over the moulding 2 and, on the other hand, on the underside of the heating element 3, boss-like pressed-out pieces 3*b*, into which a bayonet ring 7 can engage. In at least one embodiment of the present invention, the bayonet ring 7 can be metallic. An appropriate design of the bayonet ring 7 makes it possible, during mounting, to achieve, by rotation, a corresponding press fit or friction fit of the gasket 6 located between the moulding 2 and the overlapping portion 3*a* of the heating element 3. Moreover, a further gasket 6 on the underside of the moulding 2 ensures that the underside of the moulding 2 is not damaged by the bayonet ring 7, which could have adverse effects on the strength of the materials, particularly in the case of brittle materials.

Special thermally resistant flat gaskets consisting of graphite-containing materials and/or also of ceramic fiber material are suitable, here, as a gasket 6. Gaskets consisting of fluorinated elastoplastics would likewise be possible, but the use of these is restricted to special cases on account of the relatively high costs. In this example, the ceramic heating element 3 possesses, on its underside, a cutout, into which an electrically insulated heating element 8 or a special radiant-heating body is inserted with an exact fit, this likewise constituting a further possible heating method if the ceramic itself does not insulate sufficiently well electrically.

Figure 4:
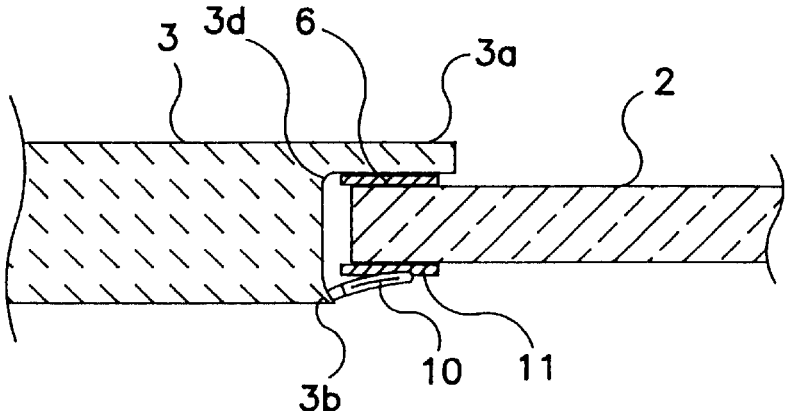
FIG. 4 shows a possible arrangement according to the present invention, enlarged, in section.

FIG. 4 shows an arrangement according to the present invention, in which the ceramic heating element 3 is held by means of an elastic fastening ring 10 in such a way that the gasket 6 undergoes a press fit or friction fit. A guard ring 11 substantially prevents direct contact between the fastening ring 10 and the underside of the moulding 2. On the one hand, the guard ring 11 protects the underside of the moulding 2 from scratches and, on the other hand, this ring 11 substantially ensures thermal insulation between the metallic fastening ring 10, which has a similar temperature to the ceramic heating element 3, and the moulding 2.

The slight bevel 3*b* of that portion of the ceramic heating element 3 which runs vertically in this region helps to ensure an improved bond between the ceramic heating element 3 engaging over the moulding 2 and the fastening ring 10, so that a good press fit or friction fit of the gasket 6 can be achieved.

A device for protecting the edges of orifices in mouldings consisting of glass-ceramic, glass or ceramic against mechanical damage and for preventing equipment located under the moulding from being soiled and damaged by liquids penetrating through the orifices in the moulding may be necessary. This protection can be accomplished by a metallic cowl engaging over the edge of the respective orifices onto the moulding by means of a collar and by means of an elastic fastening ring capable of being attached to the metallic cowl as a carrier part, the fastening ring being designed, so as to be self-clamping, as an annular washer consisting of an annular band which, when opened up, is meander-like and which is closed in the circumferential direction and is of elastically variable length over its entire radial width. An example of this can be derived from the German application bearing the file number 196 33 141.2-16, which is hereby incorporated by reference herein.

Figure 5:
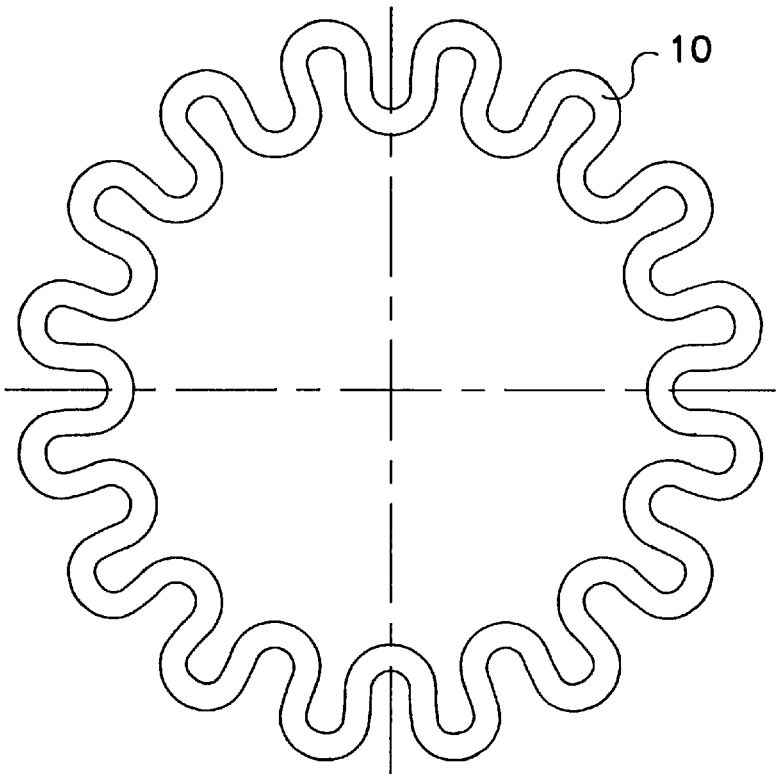
FIG. 5 shows a fastening ring consisting of a meander-like spring-steel band.

A fastening band 10 is illustrated in FIG. 5 and shows the meander-like spring-steel band.

Figure 6:
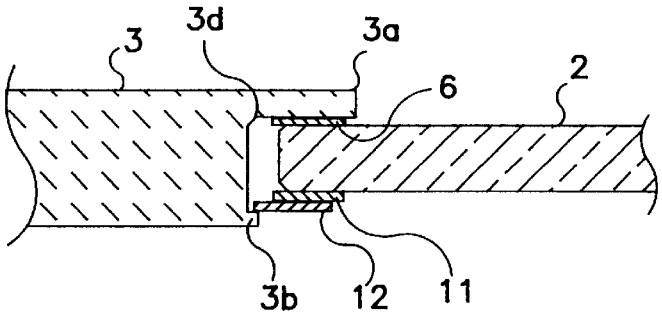
FIG. 6 shows a further possible variant of the arrangement according to the invention.
Figure 7:
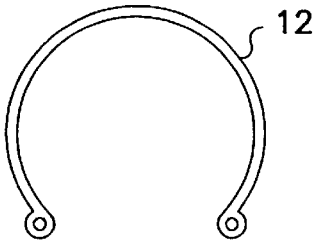
FIG. 7 shows a clamping element, such as can be used in an arrangement according to FIG. 6.
Figure 8:
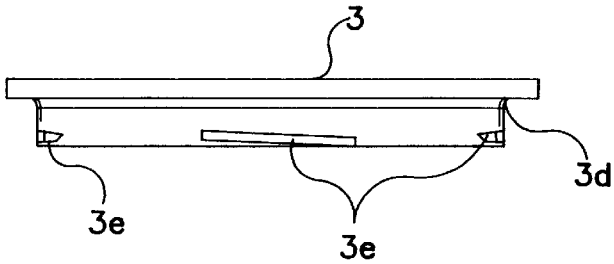
FIG. 8 shows a side view of a ceramic heating body which was prepared especially for a further possible arrangement according to the invention.

FIG. 6 shows a further embodiment of an arrangement according to the present invention, in which embodiment the ceramic heating element 3 is fastened by means of a simple clamping element 12, which clamping element 12 engages into a groove like bulge 3*b*. This clamping element 12, which is also illustrated separately in FIG. 7, can be, for example, pushed in substantially laterally during the mounting operation. Here too, a guard ring 11 can substantially prevent direct contact with the moulding 2. FIG. 8 shows a side view of a ceramic heating body 3, in which slots 3*e*, into which, for example, bayonet rings 7 can engage, have been cut by milling, the slots running obliquely in the lateral direction. A peripheral groove cut by milling, into which groove clamping rings 12 can engage, is also conceivable.

Preferably, ceramic heating elements 3, which ceramic heating elements 3 have been provided with corresponding grooves, slots or bores as early as during production by means of the sintering process, are used.

Since materials of this type can be brittle, parts which, in particular, are under tensile stress should be designed in such a way that the stresses are minimized in critical regions. Rounded milled-out portions (for example, 3*d*) can assist in achieving this purpose.

Figure 9:
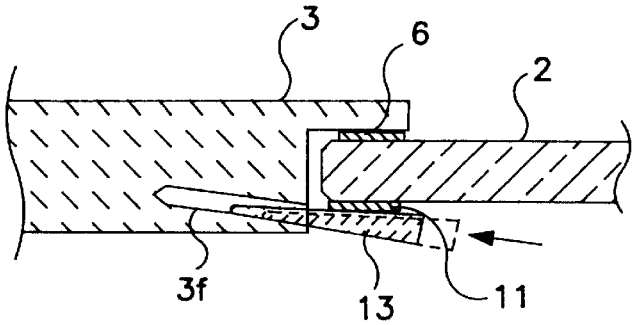
FIG. 9 shows a detail of a ceramic heating element according to FIG. 8, arranged according to the invention in a cooking surface.

FIG. 9 shows a detail of a ceramic heating element 3 held by wedge-like pins 13 which are pushed laterally into corresponding obliquely set bores 3*f* and which thus substantially ensure that the gasket 6 has a sufficient press fit or friction fit.

Figure 10:
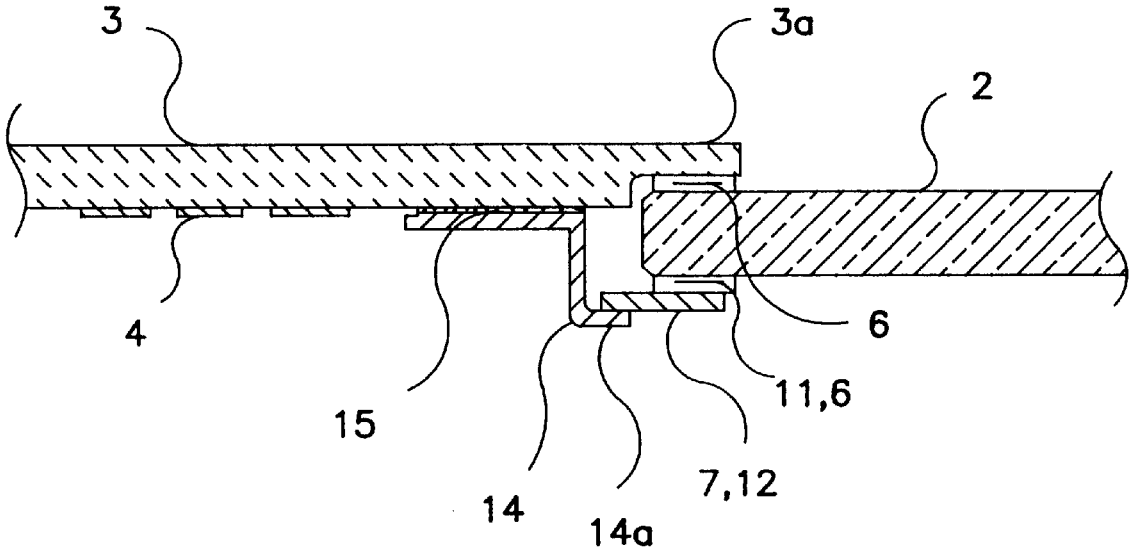
FIG. 10 shows (diagrammatically) a further arrangement with additional metal parts which themselves have grooves, threads, bosses or bores.

FIG. 10 shows diagrammatically a further embodiment, in which one or more metal parts 14 are attached from below to the ceramic carrier plate 3 by means of a hard-solder joint 15, the metal parts having, in the region below the plane of the cooking surface 2, corresponding bosses 14*a*, into which bosses 14*a* clamping rings 12 or bayonet rings 7 can engage. These metal parts 14, in the form of bracket parts or individual angles, may also have grooves, threads or bores, into which corresponding fastening means, such as bayonet rings 7, clamping elements 12, fastening rings 10 or pins 13, can engage.

Figure 11:
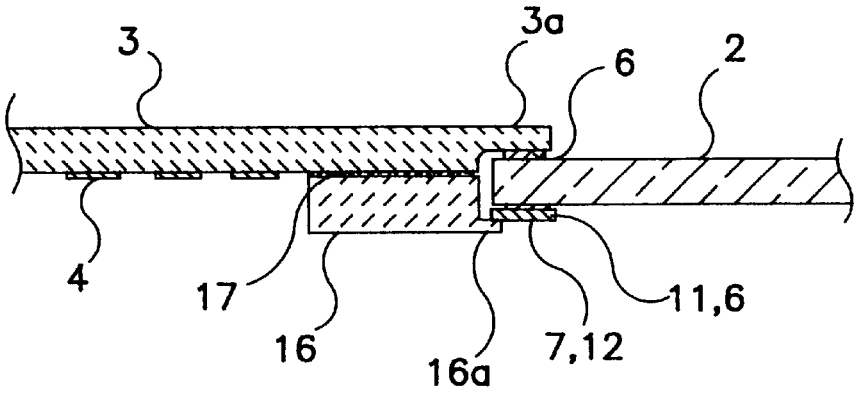
FIG. 11 shows a further arrangement, as in FIG. 10, but with additional ceramic parts.

FIG. 11 shows diagrammatically an embodiment similar to that of FIG. 10. Here, additional ceramic parts 16 having corresponding catch bosses 16*a* are glued to the underside of the ceramic carrier plate 3 by means of a ceramic adhesive 17 which adhesive is substantially resistant to high temperature. Preferably, in this case, the ceramic parts 16 comprise the same material as the ceramic carrier plate 3 in terms of the coefficient of thermal expansion. The ceramic adhesive 17 is likewise adapted to the parts 3 and 16 in terms of the coefficient of thermal expansion.

The present invention shows a simple and highly inexpensive possibility of an arrangement for mounting ceramic heating elements in cutouts of mouldings, in particular cooking surfaces comprising brittle materials, such as glass-ceramic, glass, ceramic, or else of metallic materials or suitable plastics.

This entails the following advantages:

Optimum adaptation to the materials involved

Good sealing effect even in the case of widely differing materials

A substantially increased working temperature of about 400° C., well above the 250° C. conventional hitherto, with the result that "normal" utensil quality can also be used Simple mounting/demounting during servicing Simple recycling due to fully graded separation.

One feature of the invention resides broadly in the arrangement of an electrical heating element as a cooking zone, having as a carrier 3 a ceramic of very high thermal conductivity, in a cutout of a cooking surface 2 consisting of glass-ceramic, glass, ceramic, metal or plastic, characterized in that the ceramic carrier 3 of the heating element has, above the plane of the cooking surface 2, a region 3*a*, by means of which the said carrier engages over the cutout onto the top of the cooking surface 2 and by means of which the said carrier rests on the cooking surface 2 by means of a gasket 6, and the ceramic carrier forms, in the plane of the cooking surface, a further region, by means of which the said carrier is positioned in the cutout at a distance from the end faces of the latter, and, below the plane of the cooking surface 2, a region having shaped-out portions 3*b* serving as a bearing for an element 10 which, with the aid of the cooking surface 2 as an abutment, fixes the heating element 3 positively and non-positively in the cutout of the cooking surface 2.

Another feature of the invention resides broadly in the arrangement characterized in that the shaped-out portions 3*b* of the ceramic carrier 3 of the heating element in the region below the plane of the cooking surface 2 are designed as grooves cut by milling, as threads, bosses or bores.

Yet another feature of the invention resides broadly in the arrangement characterized in that the shaped-out portions 3*b* are formed as grooves, threads or bosses on the ceramic heating element 3 by metal parts 14 attached by means of hard-solder joints 15.

Still another feature of the invention resides broadly in the arrangement characterized in that the shaped-out portions 3*b* are formed as grooves, threads or bosses on the ceramic heating element 3 by ceramic parts 16 which are attached by means of a thermally stable likewise ceramic adhesive 17 and which consist, in particular, of the same ceramic material as the ceramic heating element.

A further feature of the invention resides broadly in the arrangement characterized in that the ceramic carrier 3 of the heating element is fastened catchably in the cutout of the cooking surface 2.

Another feature of the invention resides broadly in the arrangement characterized in that the ceramic carrier 3 of the heating element can be connected screwably in the cutout of the cooking surface 2.

Yet another feature of the invention resides broadly in the arrangement characterized in that the element, with the aid of which the ceramic carrier 3 of the heating element is fixed in the cutout of the cooking surface 2, is a resilient metallic or ceramic element.

Still another feature of the invention resides broadly in the arrangement characterized in that a further material, in particular a gasket 6, is arranged in the contact region between the ceramic carrier 3 of the heating element and the cooking surface 2.

A further feature of the invention resides broadly in the arrangement characterized in that the gaskets 6 are composed of a graphite containing material and/or a ceramic fibre material.

Another feature of the invention resides broadly in the arrangement characterized in that the ceramic carrier 3 of the heating element receives an electrically insulated heating element.

Some examples of stoves and ranges which may possibly be utilized or adapted for use in the context of the present invention may be disclosed in the following U.S. Pat. No. 5,213,091, issued on May 25, 1993; No. D336,210, issued on Jun. 8, 1993; No. 5,280,152, issued on Jan. 18, 1994; No. 5,290,997, issued on Mar. 1, 1994; No. 5,400,765, issued on Mar. 28, 1995; No. D359,345, issued on Jun. 13, 1995; No. D361,015, issued on Aug. 8, 1995; and No. 5,464,005, issued on Nov. 7, 1995.

Some examples of burners and related components which may possibly be utilized or adapted for use in the context of the present invention may be disclosed in the following U.S. Pat. No. 4,758,710, issued on Jul. 19, 1988; No. 4,899,723, issued on Feb. 13, 1990; No. 5,186,158, issued on Feb. 16, 1993; No. D333,943, issued on Mar. 16, 1993; No. 5,323,759, issued on Jun. 28, 1994; No. 5,329,918, issued on Jul. 19, 1994; No. 5,397,234, issued on Mar. 14, 1995; No. 5,397,873, issued on Mar. 14, 1995; No. 5,400,765, issued on Mar. 28, 1995; and No. 5,437,262, issued on Aug. 1, 1995.

Some examples of related components for stoves and ranges which may possibly be utilized or adapted for use in the context of the present invention may be disclosed in the following U.S. Pat. No. 5,220,155, issued on Jun. 15, 1993; No. 5,245,159, issued on Sep. 14, 1993; No. 5,343,020, issued on Aug. 30, 1994; No. 5,377,660, issued on Jan. 3, 1995; No. 5,380,985, issued on Jan. 10, 1995; and No. 5,400,766, issued on Mar. 28, 1995.

Some examples of cooking hobs and cooktops which may possibly be utilized or adapted for use in the context of the present invention may be disclosed in the following U.S. Pat. No. 5,406,932, issued on Apr. 18, 1995; No. 5,422,460, issued on Jun. 6, 1995; No. 5,424,512, issued on Jun. 13, 1995; No. 5,425,353, issued on Jun. 20, 1995; No. 5,429,114, issued on Jul. 4, 1995; and No. 5,448,036, issued on Sep. 5, 1995.

Some examples of ceramic plates or hot plates which may possibly be utilized or adapted for use in the context of the present invention may be disclosed in the following U.S. Pat. No. 3,596,650, issued on Aug. 3, 1971; No. 3,870,861, issued on Mar. 11, 1975; No. 4,414,465, issued on Nov. 8, 1983; No. 4,634,841, issued on Jan. 6, 1987; and No. 5,397,873, issued on Mar. 14, 1995.

Some examples of resistors printed on or disposed on a ceramic material which may possibly be utilized or adapted for use in the context of the present invention may be disclosed in the following U.S. Pat. No. 4,004,130, issued on Jan. 18, 1977; No. 4,160,897, issued on Jul. 10, 1979; No. 4,762,982, issued on Aug. 9, 1988; No. 5,264,681, issued on Nov. 23, 1993; and No. 5,700,338, issued on Dec. 23, 1997.

Some examples of ceramic materials which may possibly be utilized or adapted for use in the context of the present invention may be disclosed in the following U.S. Pat. No. 5,385,873, issued on Jan. 31, 1995; No. 5,407,740, issued on Apr. 18, 1995; No. 5,420,399, issued on May 30, 1995; No. 5,422,319, issued on Jun. 6, 1995; No. 5,449,649, issued on Sep. 12, 1995; No. 5,476,684, issued on Dec. 19, 1995; and No. 5,691,261, issued on Nov. 25, 1997.

Some examples of adhesive materials which may possibly be utilized or adapted for use in the context of the present invention may be disclosed in the following U.S. Pat. No. 5,225,662, issued on Jul. 6, 1993; No. 5,268,338, issued on Dec. 7, 1993; No. 5,288,674, issued on Feb. 22, 1994; No. 5,300,627, issued on Apr. 5, 1994; No. 5,403,228, issued on Apr. 4, 1995; No. 5,432,320, issued on Jul. 11, 1995; No. 5,468,290, issued on Nov. 21, 1995; and No. 5,475,044, issued on Dec. 12, 1995.

Some examples of thermally insulating materials which may possibly be utilized or adapted for use in the context of the present invention may be disclosed in the following U.S. Pat. No. 5,408,832, issued on Apr. 25, 1995; No. 5,420,401, issued on May 30, 1995; No. 5,449,232, issued on Sep. 12, 1995; No. 5,456,682, issued on Oct. 10, 1995; and No. 5,469,683, issued on Nov. 28, 1995.

German Patent No. 30 49 491 C2, German Patent No. 42 27 672 C2, French Patent No. 2 626 964, European Patent No. 0 069 298 B1 and German Patent Application No. 197 05 715.2-16 are hereby incorporated as if set forth in their entirety herein.

U.S. patent application Ser. No. 09/022,918, entitled "COOKING UNIT, SUCH AS A STOVE, FOR COOKING FOOD", filed on Feb. 12, 1998, and having the inventors Dr. Peter Nass, Dr. Patrick Hoyer and Dr. Kurt Schaupert, is hereby incorporated by reference as it set forth in its entirety herein.

U.S. patent application Ser. No. 09/022,466, entitled "COOKING APPLIANCE, SUCH AS A STOVE, WITH A GLASS CERAMIC HOB OR COOKTOP WITH A RAPID COOKING RING OR HOTPLATE", filed on Feb. 12, 1998, and having the inventors Martin Taplan, Herwig Scheidler and Christof Köster is hereby incorporated by reference as if set forth in its entirety herein.

U.S. patent application, Ser. No. 09/176,981, filed on or about Oct. 22, 1998, having the inventors Bernd Schultheis and Martin Taplan, having Attorney Docket No. NHL-SCT-05 US, entitled "COOKING APPLIANCE SUCH AS A STOVE WITH AN ARRANGEMENT OF A CERAMIC HEATING ELEMENT AS A COOKING ZONE IN A CUT-OUT OF A SURFACE", is hereby incorporated by reference as if set forth in its entirety herein.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 197 46 844.6, filed on Oct. 23, 1997, having inventor Bernd Schultheis, and DE-OS 197 46 844.6 and DE-PS 197 46 844.6, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

LIST OF REFERENCE SYMBOLS

1 Cooking hob
2 Cooking surface (moulding)
3 Ceramic heating element
3*a* Overlapping portion
3*b* Shaped-out portion
3*c* Cutout for receiving insulated heating elements (8)
3*d* Milled-out portion
3*e* Slots (cut by milling)
3*f* Bore.
4 Heating conductor
5 (Silicone) adhesive
6 Gasket
7 Bayonet ring
8 Heating element (insulated)
9 Electrical contacting
10 Fastening ring (meander-like)
11 Guard ring
12 Clamping element
13 Pins (wedge-like)
14 Additional metal part
14*a* Boss
15 Hard-solder joint
16 Additional ceramic part
16*a* Boss
17 Ceramic adhesive bond

What is claimed is:

1. A cook top for cooking food, said cook top comprising:

a housing;

said housing comprising a cooking surface, said cooking surface having a top and a bottom;

said cooking surface comprising a cutout portion;

a heating arrangement comprising a carrier and an electrical heating element disposed in said carrier;

said heating arrangement being disposed at said cutout portion of said cooking surface;

said carrier comprising a first portion, said first portion of said carrier being disposed above said cutout portion and adjacent said top of said cooking surface to rest on said cooking surface;

a gasket;

said gasket being disposed between said first portion of said carrier and said top of said cooking surface;

said carrier comprising a second portion;

said second portion of said carrier being disposed below said top of said cooking surface;

a fastening element;

said second portion comprising a part to receive said fastening element, said receiving part being disposed below said top of said cooking surface and also adjacent to said cutout portion;

said receiving part being configured and disposed to engage said fastening element; and said fastening element being disposed and configured to engage said receiving part and simultaneously to abut said bottom of said cooking surface to thus hold said heating arrangement in said cutout portion.

2. The cook top according to claim 1 wherein said cooking surface comprises at least one of glass-ceramic, glass, ceramic, metal, and plastic.

3. The cook top according to claim 2 wherein said carrier of said heating arrangement comprises ceramic, said ceramic having a high thermal conductivity.

4. The cook top according to claim 3 wherein:

said cooking surface comprises a facing in said cooking surface, said facing surrounding said cutout portion and defining said cutout portion;

said cooking surface having a thickness between said top of said cooking surface and said bottom of said cooking surface;

said cooking surface defining a plane, said plane substantially bisecting said thickness of said cooking surface;

said carrier comprises a third portion;

said third portion of said carrier being disposed substantially in said cutout portion, substantially in said plane of said cooking surface; and said third portion of said carrier being disposed a distance from said facing, to allow a space between said facing and said third portion.

5. The cook top according to claim 4 wherein:

said receiving part comprises a recessed portion;

said recessed portion comprises a bearing to engage said fastening element; and said fastening element being disposed and configured to fix said heating arrangement in said cutout portion.

6. The cook top according to claim 5 wherein said recessed portion of said receiving part comprises one of grooves, threads, bosses, or bored portions.

7. The cook top according to claim 6 wherein said fastening element comprises:

a resilient fastening element; and one of metal and ceramic.

8. The cook top according to claim 7 comprising:

an additional gasket; and said additional gasket being disposed between said fastening element and said bottom of said cooking surface.

9. The cook top according to claim 8 wherein said gasket and said additional gasket each comprise at least one of a graphite containing material, and a ceramic fiber material.

10. The cook top according to claim 9 wherein said fastening element comprises one of a), b), and c):

a) a bayonet ring; and said bayonet ring being disposed to engage said receiving element;

b) an elastic fastening ring;

said elastic fastening ring being disposed and configured to hold said gasket by a friction fit;

a guard ring; and said guard ring being disposed and configured to substantially prevent contact between said fastening ring and said bottom of said cooking surface; and c) a clamping element; and said clamping element being disposed to clamp said heating arrangement in said cutout portion.

11. The cook top according to claim 10 wherein said electrical heating element is electrically insulated.

12. The cook top according to claim 11 wherein said receiving part is formed by milling.

13. The cook top according to claim 12 wherein said receiving part is formed from one piece with the heating arrangement.

14. The cook top according to claim 13 wherein said heating arrangement is one of caught into said cutout portion, or threaded into said cutout portion.

15. The cook top according to claim 12 wherein:

said receiving part comprises metal; and said metal receiving part being hard soldered to said heating arrangement.

16. The cook top according to claim 15 wherein said heating arrangement is one of caught into said cutout portion, or threaded into said cutout portion.

17. The cook top according to claim 12 wherein:

said receiving part comprises a separate ceramic part; and said separate ceramic part comprises the same ceramic material as the ceramic of said heating arrangement.

18. The cook top according to claim 17 wherein said separate ceramic part is attached to said heating arrangement with thermally stable ceramic adhesive.

19. The cook top according to claim 18 wherein said heating arrangement is one of caught into said cutout portion, or threaded into said cutout portion.

20. Arrangement of an electrical heating element as a cooking zone, having as a carrier a ceramic of very high thermal conductivity, in a cutout of a cooking surface consisting of glass-ceramic, glass, ceramic, metal or plastic, the cutout defining end faces about the outside of the cutout, characterized in that the ceramic carrier of the heating element has, above the plane of the cooking surface, a region, by means of which the carrier engages over the cutout onto the top of the cooking surface and by means of which the carrier rests on the cooking surface by means of a gasket, and the ceramic carrier forms, in the plane of the cooking surface, a further region, by means of which the carrier is positioned in the cutout at a distance from the end faces of the latter, and, below the plane of the cooking surface, a region having shaped-out portions serving as a bearing for an element which, with the aid of the cooking surface as an abutment, fixes the heating element in the cutout of the cooking surface.

* * * * *